US005317942A

United States Patent [19]

Nakajima

[11] Patent Number: 5,317,942

[45] Date of Patent: Jun. 7, 1994

[54] ROTARY PERFORATOR, METHOD FOR PERFORATING A WEB, AND WEB PERFORATED BY THE ROTARY PERFORATOR

[75] Inventor: Syuiti Nakajima, Hachioji, Japan

[73] Assignee: Konica Corporation, Tokyo, Japan

[21] Appl. No.: 928,411

[22] Filed: Aug. 12, 1992

[30] Foreign Application Priority Data

Aug. 15, 1991 [JP] Japan ..... 3-205231
Aug. 27, 1991 [JP] Japan ..... 3-215421

[51] Int. Cl.[5] ..... B26F 1/08

[52] U.S. Cl. ..... 83/50; 83/310; 83/337; 83/410.8; 83/602

[58] Field of Search ..... 83/602, 310, 410.8, 83/50, 267, 337; 74/56

[56] References Cited

U.S. PATENT DOCUMENTS

| | | | |
|---|---|---|---|
| 234,037 | 11/1880 | Jentzsch | 83/136 X |
| 549,707 | 11/1895 | Denney | 83/310 X |
| 1,333,940 | 3/1920 | Seymour | 83/602 X |
| 1,910,395 | 5/1933 | Kreis | 83/310 |
| 2,760,576 | 8/1956 | Spencer | 83/310 X |
| 2,963,932 | 12/1960 | Glueck | 83/337 |
| 3,661,044 | 5/1972 | Duden et al. | 83/337 X |
| 3,682,029 | 8/1972 | Haas et al. | 83/69 |
| 3,916,744 | 11/1975 | West | 83/175 |
| 3,943,810 | 3/1976 | Muylle | 83/337 |
| 4,287,748 | 9/1981 | Wolfthal | 83/267 X |
| 4,903,743 | 2/1990 | Zweig | 144/3 R |

FOREIGN PATENT DOCUMENTS

| | | |
|---|---|---|
| 0292863A3 | 6/1991 | European Pat. Off. . |
| 1260302 | 2/1968 | Fed. Rep. of Germany . |
| 2022757 | 11/1970 | Fed. Rep. of Germany . |
| 2039801 | 2/1972 | Fed. Rep. of Germany . |
| 50-44583 | 4/1975 | Japan . |
| 63-39036 | 10/1988 | Japan . |
| 1314163 | 4/1973 | United Kingdom . |

OTHER PUBLICATIONS

Filmfinishing Machines, Signing and Measuring Instruments, Buko Co. catalog. (undated).

*Primary Examiner*—Richard K. Seidel
*Assistant Examiner*—Kenneth E. Peterson
*Attorney, Agent, or Firm*—Finnegan, Henderson, Farabow, Garrett & Dunner

[57] ABSTRACT

A perforator for perforating a web. The perforator has a rotatable drum for supporting the web; an arm having a punch, which rotates integrally with the drum; a driver for swinging the arm, which rotates integrally with the drum; and a taper rib which does not rotate with the drum, in which the taper rib is provided with a roller gear cam for engaging with the taper rib which is provided on a circumference concentric with the drum in a cross section perpendicular to an axis of the drum, so that the taper rib causes the driver to swing and the punch perforates the web with rotation of the drum.

25 Claims, 11 Drawing Sheets

ROTARY PERFORATOR, METHOD FOR PERFORATING A WEB, AND WEB PERFORATED BY THE ROTARY PERFORATOR

BACKGROUND OF THE INVENTION

The present invention relates to a rotary perforator which can perforate a web such as a film, tape and paper at high speed and quality, wherein the maintenance of the rotary perforator can be simplified and the productivity is high, and further the present invention relates to a method for perforating the web with the rotary perforator, and furthermore relates to the web which has been perforated by the rotary perforator.

Since the rotary perforator can be operated at high speed, its productivity is high, and further the rotary perforator is advantageous in the reduction of manufacturing cost. Accordingly, it is widely put into practical use. A conventional rotary perforator is shown in FIG. 12, which is commercially available, and other rotary perforators of the prior art are disclosed in the specification of the U.S. Pat. No. 3,916,744, the official gazette of Japanese Patent Application Open to Public Inspection No. 44583/1975 (shown in FIG. 13), and the official gazette of Japanese Utility Model No. 39036/1988.

From the viewpoint of improvements in productivity, perforators must be operated at high speed and quality, and further their maintenance must be simplified. However, the conventional perforators do not meet the requirements.

For example, according to the U.S. Pat. No. 3,916,744 and Japanese Patent Application Open to Public Inspection No. 44583/1975 (shown in FIG. 13), a disk 202, the center of which is eccentric to a main shaft around which a drum 201 is rotated, is provided close to the drum 201 by which film perforation is conducted. On the disk 202, a plurality of arms 203 provided with punches are fixed onto the disk 202. When the disk is rotated in accordance with the rotation of the drum, the arm 203 is displaced radially on the disk since there is a distance between the center 205 of the drum and the center 206 of the disk. As a result, the punch section 204 mounted on the tip of the arm 203 rotated integrally with the drum 201, is linked with the arm 203, so that the punch section 204 can be swung around a predetermined shaft (not shown) which is supported so that it can be rotated integrally with the drum. Therefore, the punch section 204 is oscillated around the shaft, and perforates a film in cooperation with a plurality of dies (not shown) provided along the circumference of the drum 201 corresponding to the punch sections 204. In FIG. 13, the film is supplied from the left as shown by an arrow mark, and wound around the drum 201, and then the film advances to the right as shown by an arrow mark. Since FIG. 13 is a front view, only a portion of the punch section 204 is illustrated in the drawing.

This kind of machine is capable of conducting a high speed perforating operation. However, since the main shaft of the drum and the center of the disk are shifted, that is, the center of the disk is eccentric to the main shaft of the drum, the arm body and the punch section are not aligned on a line in some stage of the rotation of the disk which is rotated around the drum. As a result, a load is given to a portion of the arm, so that the frequency of maintenance operations is increased. Because of the aforementioned disadvantage, it is not possible to stably conduct perforation at high speed and quality.

The aforementioned disadvantage caused by the load partially given to the arm due to the eccentricity between the main shaft of the drum and the center of the disk, is solved by the aforementioned machine available on the market and also solved by the machine disclosed in the official gazette of Japanese Utility Model 39036/1988.

These machines utilize a channel cam mechanism. These mechanisms are structured in the following manner: an arm body 133 is provided to a cam groove 122 through a cam follower 131. Accordingly, the occurrence can be prevented in which an arm body 133 and a punch section 156 are not aligned on a line in the radial direction of a disk (groove cam) 121. However, even in the aforementioned machine, a load is given to the connection of the arm body and the punch section. That is, in order to improve the efficiency of force given to the punch, it is effective to increase the ratio of the distance from a shaft 152 to a roller 153, to the distance from the shaft 152 to a punch 155. However, when the ratio is increased in the aforementioned manner, dimensions of the apparatus are increased. Therefore, a load given to the roller is increased. When a play is caused in the roller, it is successively caused between the cam groove 122 and the cam follower 131. As a result, vibrations are caused in the apparatus, and accuracy of perforation is deteriorated. Consequently, it becomes difficult to carry out perforating operations at high speed and quality.

In FIG. 12, numeral 1 is a film, numeral 100 is a main body which is not rotated, numeral 111 is a drum, numeral 112 is a die which is provided along the circumference of the drum, numeral 113 is a flange which is rotated integrally with the drum, numeral 133A is a groove which receives the roller 153 connecting the arm body 133 and the punch section 156, and numeral 151 is a bracket which supports the shaft 152 of the punch section 156 and is rotated integrally with the drum 111.

In the case of the machine available on the market, the arm body 133 is brought into contact with a guide 114. Accordingly, when the groove-cam mechanism is displaced in the radial direction, the arm body 133 slides on the surface of the groove. The guide surface is flat, so that lubricating oil is not maintained in a good condition on the surface. Therefore, the arm body 133 seizes up, and it can not be slid smoothly, so that the accuracy of perforation is affected. When an excessive amount of lubricating oil is supplied to the sliding portion, there is a possibility that the supplied oil spills and stains the film surface.

The punch to carry out perforating operations is provided at the tip of the punch section 156. When the punch is worn out, it is ground down. Accordingly, the length of the punch is reduced. The punch must be set at a predetermined position so that it can be engaged with the die. However, when the length of the punch is changed, the punch position is also changed, so punch engaging accuracy is lowered. Therefore, the punching performance is deteriorated, and depending on the case, punching operations can not be carried out. When the aforementioned defective punching operations are conducted a large number of times, productivity is remarkably lowered, and it is difficult to obtain products of high quality.

FIGS. 14 and 15 show the operations of the punch 155 and the stripper 154 of an apparatus available on the market. A slide groove 158 is formed at the tip of a lever 156 illustrated in FIG. 12, and a compression spring 157 is provided into the bottom portion of the slide groove 158. Further, the stripper 154 is slidably inserted into the slide groove 158. The stripper 154 is pushed outside of the slide groove 158 by the spring 157. A stopping device (not shown) is provided so that the stripper 154 can not be excessively protruded from the slide groove 158. FIG. 14 shows a state in which the stripper 154 is brought into contact with the film 1 located on the die 112 provided on the drum 111 surface, and the punch 155 has entered the die 112 and completed a perforating operation of the film 1. The stripper 154 is separated from the film surface concurrently when the punch 155 is disengaged from the punched hole of the film, or immediately after that, so that the film 1 can not be raised when the punch 155 is separated from the die 112. However, as shown in FIG. 15, there is a possibility that the surface of the film 1 is damaged by the stripper 154 in the following manner: from when the punch 155 has perforated the film 1, to when the stripper 154 is separated from the film 1, the distance between the edge 154A of the stripper 154 and the rotary shaft 152 of the lever 156 is changed from R shown in FIG. 14 to R′ shown in FIG. 15; and as a result, the stripper 154 rubs the film surface in the range from R to R′ by the force of the spring 157 and the weight of the stripper 154. Further, in the process in which the stripper 154 is brought into contact with the film 1 and presses the film 1 against the die 112, there is a possibility that the same problem is caused. At worst, the film 1 is displaced from the appropriate position on the die 112, and can not be perforated appropriately.

SUMMARY OF THE INVENTION

The present invention has been achieved to solve the aforesaid conventional problems. It is a primary object of the present invention to provide a rotary perforator in which a load is not partially given to a specific member and maintenance can be simplified, and by which perforating operations can be conducted at high speed and quality. Further, it is an object of the present invention to provide a perforation method for perforating webs. Furthermore, it is an object of the present invention to provide a perforated web of high quality manufactured by an apparatus of high accuracy.

The aforesaid objects can be accomplished by the following means (1) to (6).

(1) A perforator for perforating a web in which the perforator has a rotatable drum for supporting the web; an arm having a punch, which rotates integrally with the drum; a driver for swinging the arm, which rotates integrally with the drum; and a taper rib which does not rotate with the drum, in which the taper rib is provided with a roller gear cam for engaging with the taper rib which is provided on a circumference concentric with the drum in a cross-section perpendicular to an axis of the drum, so that the taper rib causes the driver to swing and the punch perforates the web with rotation of the drum.

(2) A method for perforating a web, having steps of; holding the web on an apparatus, which includes a rotatable drum for supporting the web; an arm having a punch, which rotates integrally with the drum; a driver for swinging the arm, which rotate integrally with the drum; and a taper rib which does not rotate with the drum, in which the taper rib is provided with a roller gear cam for engaging with the taper rib which is provided on a circumference concentric with the drum in a cross-section perpendicular to an axis of the drum, so that the taper rib causes the driver to swing and the punch perforates the web with rotation of the drum; and perforating the web.

(3) A web which is perforated by a perforator which has a rotatable drum for supporting the web; an arm having a punch, which rotates integrally with the drum; a driver for swinging the arm, which rotates integrally with the drum; and a taper rib which does not rotate with the drum, in which the taper rib is provided with a roller gear cam for engaging with the taper rib which is provided on a circumference concentric with the drum in a cross-section perpendicular to an axis of the drum, so that the taper rib causes the driver to swing and the punch perforates the web with rotation of the drum.

(4) A perforator for perforating a web, in which the perforator has; a rotatable drum for supporting the web; a punch which rotates integrally with the drum; a roller gear cam for swinging the punch which rotates integrally with the drum and includes, a first shaft provided on a circumference surface of the drum, around which the punch swings; a first arm which swings around the first shaft with rotation of the drum and moves with the punch; a second shaft provided on a circumference concentric with the drum in a cross-section perpendicular to an axis of the drum; a second arm which swings around the second shaft; a third arm which connects the first arm with the second arm, and swings against each of the first arm and the second arm; and taper rib for driving the roller gear cam, so that the second arm swings around the second shaft with rotation of the drum and causes the punch to perforate the web.

(5) A method for perforating a web, having steps of; holding the web on an apparatus, which includes a rotatable drum for supporting the web; a punch which rotates integrally with the drum; a roller gear cam for swinging the punch which rotates integrally with the drum and includes, a first shaft provided on a circumference surface of the drum, around which the punch swings; a first arm which swings around the first shaft with rotation of the drum and moves with the punch; a second shaft provided on a circumference concentric with the drum in a cross-section perpendicular to an axis of the drum; a second arm which swings around the second shaft; a third arm which connects the first arm with the second arm, and swings against each of the first arm and the second arm; and taper rib for driving the roller gear cam, so that the second arm swings around the second shaft with rotation of the drum and causes the punch to perforate the web; and perforating the web.

(6) A web which is perforated by a perforator which has a rotatable drum for supporting the web; a punch which rotates integrally with the drum; a roller gear cam for swinging the punch which rotates integrally with the drum and includes, a first shaft provided on a circumference surface of the drum, around which the punch swings; a first arm which swings around the first shaft with rotation of the drum and moves with the punch; a second shaft provided on a circumference concentric with the drum in a cross-section perpendicular to an axis of the drum; a second arm which swings around the second shaft; a third arm which connects the first arm with the second arm, and swings against each of the first arm and the second arm; and taper rib for driving the roller gear cam, so that the second arm swings around the second shaft with rotation of the drum and causes the punch to perforate the web.

DETAILED DESCRIPTION OF THE PREFERRED EMBODIMENT

The apparatus of the present invention is suitable for perforating a web such as film, tape and paper at high accuracy. A case in which a long photographic film is perforated, is taken for an example, which will be explained as follows.

Figure 1:
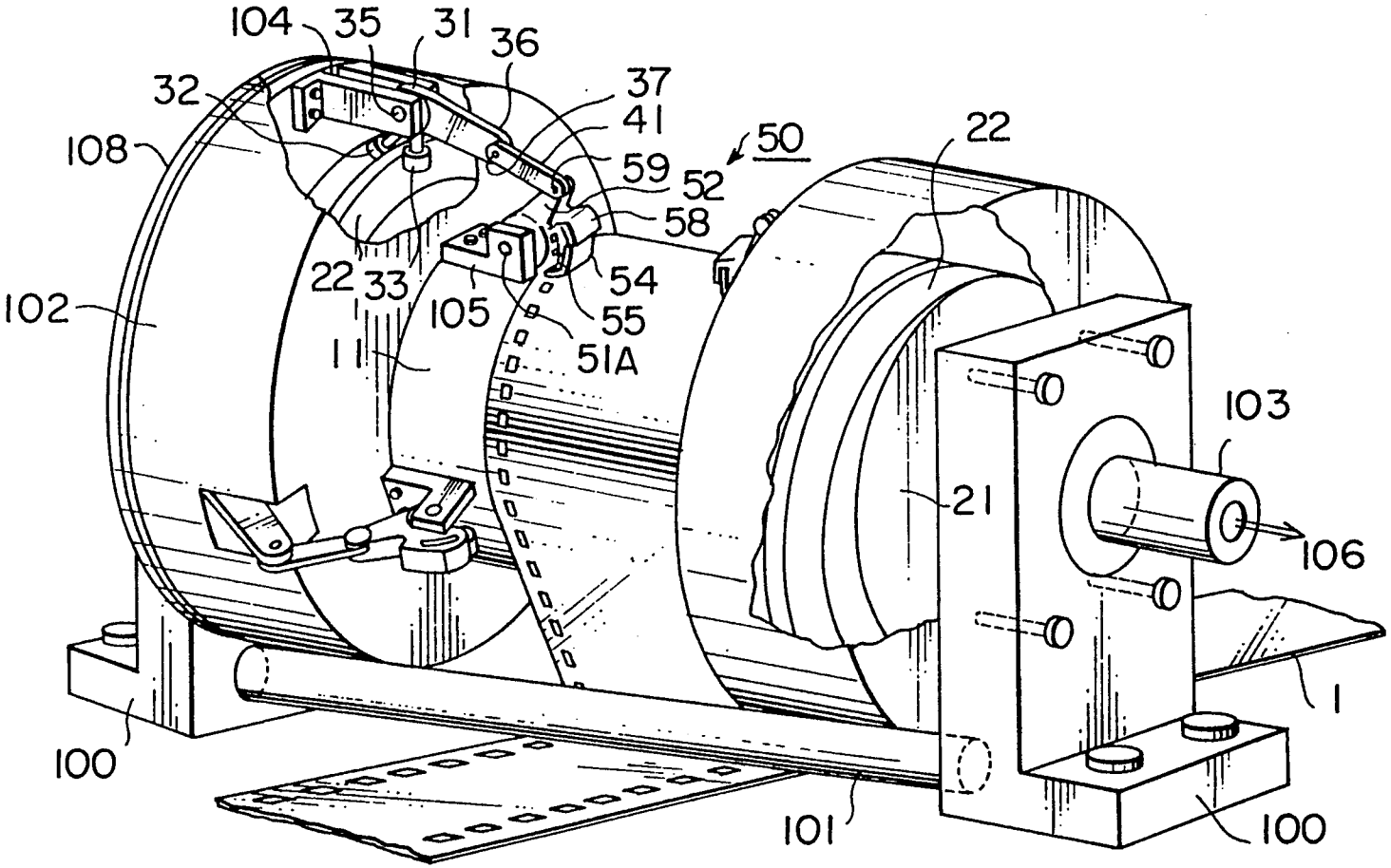
FIG. 1 is a perspective view showing a main portion of the apparatus of the present invention.
Figure 2:
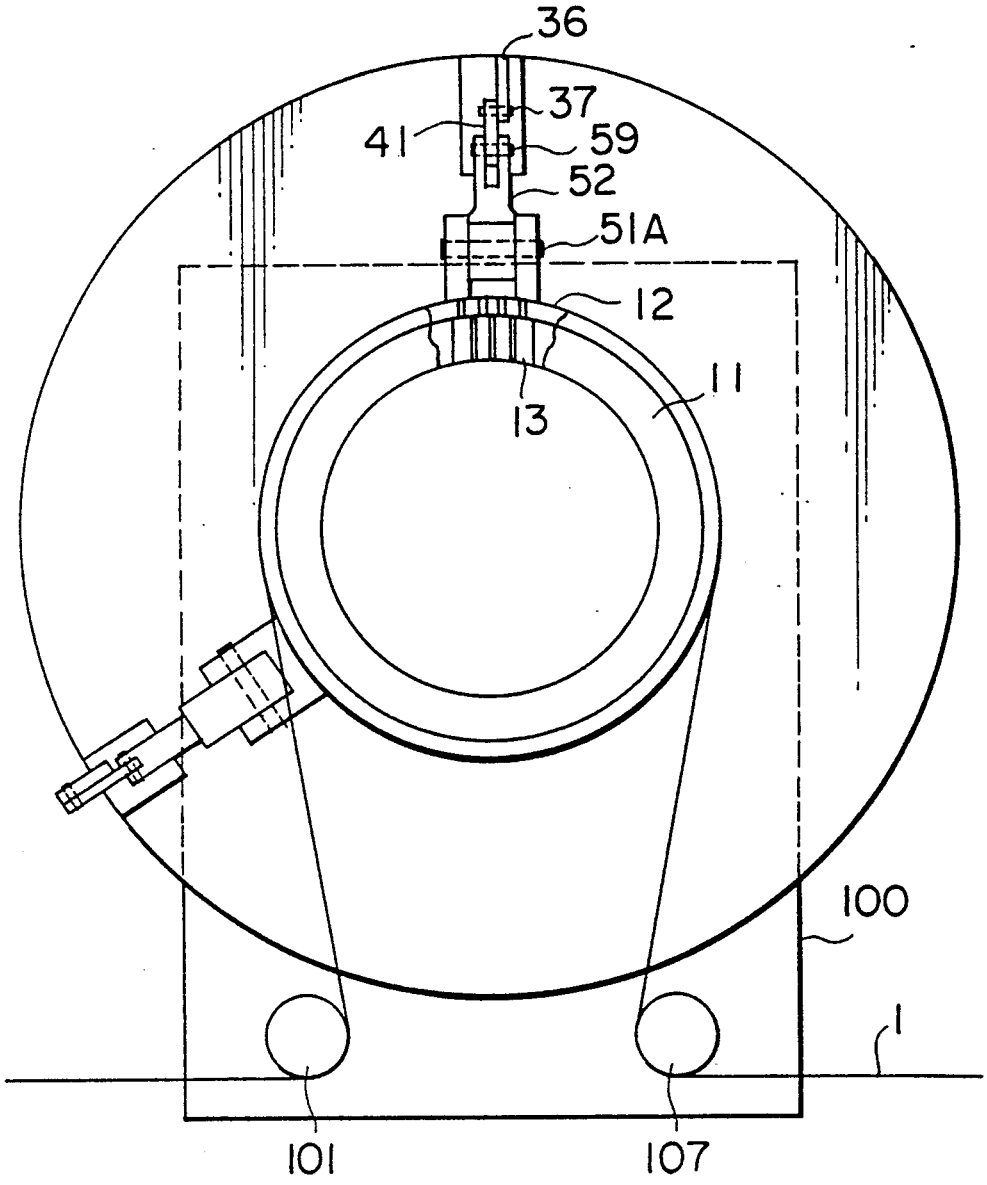
FIG. 2 is a front view showing the outline of the apparatus of the present invention.

As shown in FIGS. 1 and 2, a photographic film 1, which has not been perforated yet, is conveyed to the outer circumferential surface of a drum 11, wherein tension is given to the photographic film 1 by guide rollers 101 and 107. The tension is adjusted by a dancer roller (not shown) before or after the film 1 is sent to the perforator. In the case where the film 1 is broken, it is detected by a pin-shaped actuator of a micro-switch which is disposed at the bouncer roller or right below the drum 11.

A plurality of dies 12 are disposed at predetermined intervals in one row or two rows on the outer circumferential surface of the drum 11. One or a plurality of openings 12A are formed in the die 12 so that the opening 12A can be engaged with the punch 55. Pressure inside the drum 11 is reduced by the suction 106 and the opening 12A of the die 12 is communicated with the inside of the drum 11, so that the film 1 is brought into pressure contact with the die 12 of the film 1. It is preferable that the pressure inside the drum is detected by a pressure sensor appropriately provided. For example, in the case where the opening 12A of the die 12 is stopped up with perforation chips, or an exhaust valve is mistakenly operated, the pressure sensor detects the abnormal pressure.

Figure 3:
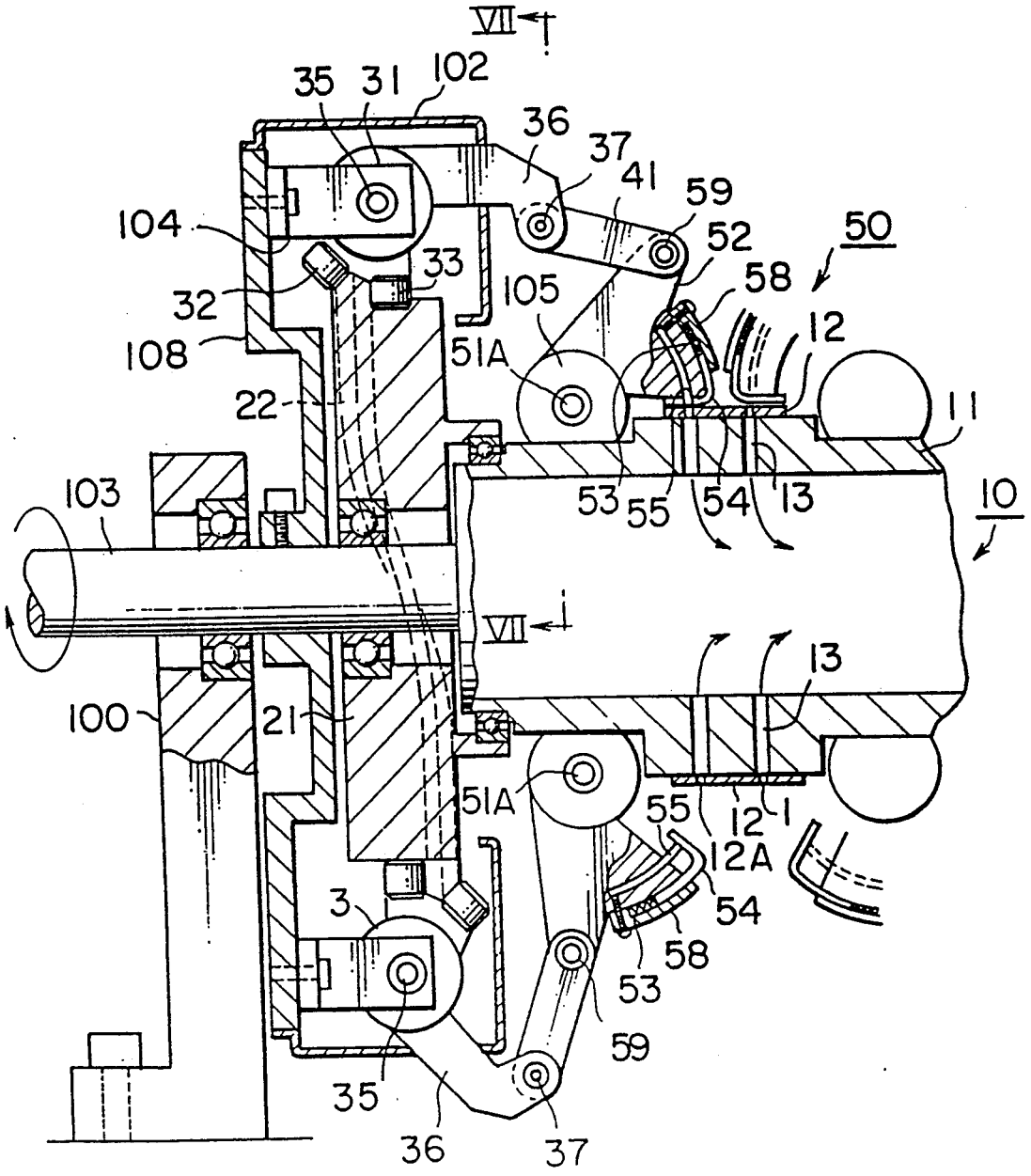
FIG. 3 is a sectional view taken on a line including the main shaft of the drum of the apparatus of the present invention.

As illustrated in FIG. 3, the drum 11 is rotated by a main shaft 103. The primary shaft 103 is rotated when a pulley (not shown) provided to the main shaft 103 is driven by a timing belt (not shown). When the perforator is combined with another process, it is preferable that the rotating speed of the primary shaft is synchronized with its film conveyance speed.

A plurality of punch units 50 including a punch 55, stripper 54 and stripper cover 58, is provided as cooperating with each die 12, on the circumferential surface of the drum 11 so that the punch unit 50 can be operated integrally with a lever 52 which is the first lever. The lever 52 can be oscillated around a support shaft 51A which is the first support shaft supported by a bracket 105 mounted on the drum 11, so that the lever 52 can be rotated integrally with the drum 11. The support shaft 51A is preferably disposed on the same plane as the surface of the film 1. Due to the aforesaid structure, the punch unit is rotated integrally with the drum 11. In FIGS. 1 and 2, only punches 55 and strippers 54 are illustrated for simplification. In the apparatus of the invention, a plurality of punches 55 and related members are provided around the drum 11, however, for the purpose of simplification, the punch 55 and related members in the process of a punching operation are shown in the upper portion in FIG. 3, and the punch 55 and related members which have completed a punching operation, are shown in the lower portion in FIG. 3, wherein the phase of the latter case is shifted by 180° from the phase of the former case. In FIG. 3, two rows of dies are illustrated, however, one row of dies are illustrated in detail, and the other row of dies are briefly shown in the drawing.

A member 108 rotated integrally with the drum 11 by the main shaft 103, is provided between the drum 11 and the main body 100 which is fixed to the drum 11. A plurality of brackets 104 are provided to the member 108 so that the brackets 104 can be rotated around the main shaft 103 integrally with the member 108. Each bracket 104 is provided with a support shaft 35 which is the second support shaft. All support shafts 35 are disposed on a tangential line of the circumference concentric to the main shaft 103, and rotated around the main shaft 103 integrally with the drum 11. A roller gear 31 having a lever 36, which is the second lever, and rollers 32, 33, is provided so that the roller gear 31 can be oscillated around the support shaft 35. Between the member 108 and the drum 11, a roller gear cam 21 which is fixed to the main body 100 so that it can not be rotated, is provided (the position where the roller gear cam 21 and the main body 100 are fixed to each other is not illustrated in the drawing). A tapered rib 22 is formed on the outer circumferential surface of the roller gear cam 21. The roller gears, the number of which is the same as that of the punch units 50, are provided on the tapered rib 22. Since the rollers 32 and 33 are disposed so that they pinch the tapered rib 22, the roller gear 31 is regulated so that it can be moved on the taper rib 22. The orbit of the taper rib 22 is composed in the following manner: when the roller gear 31 is moved on the outer circumferential surface of the roller gear cam 21 with regard to the main shaft 103 of the drum, the roller gear 31 can be oscillated around the support shaft 35. Therefore, the lever 36 is oscillated around the support shaft 35. The lever (crank lever) 36, which is the second lever, and a lever (passive lever) 52, which is the first lever, are connected with each other by a lever (connecting rod) 41, which is the third lever, through joints 37 and 59. The distance between the support shaft 35 and the support shaft 51A is constant while the drum 11 is rotated by one revolution together with the main shaft 103, so that the positional relation between them is not changed. Any sectional views taken on the surface including the main shaft 103 are the same as the sectional view shown in FIG. 3. Levers 36, 41 and 52 provided that there is a hypothetical link between the support shafts 35 and 51A, form a 4-rod-link in a broad sense mentioned below. A cover 102 is provided around the member 108 so that all the roller gears 31 can be covered.

The number of punches provided in one punch unit 50 may be one or plural. In the apparatus shown in FIG. 2, four punches are provided in one punch unit 50. In FIG. 2 the total number of the punches disposed around the drum 11 is the same as that of the openings 12A of the die 12. When one punch unit 50 is provided with 4 punches, 25 punch units 50 are preferably provided around the drum 11 in the case where 135 mm films are perforated. It is preferable that the rotary perforator is made compact. The inventors have found that the following correlation exists between the interval (pitch: P) of the holes to be perforated and the minimum diameter (diameter: D) of the drum:

$$\pi D/n > P$$

where the number of blades provided to one punch is n, and the circular constant is $\pi$.

From the aforesaid correlation, the minimum drum diameter required can be obtained as follows:

$$D = Pn/\pi$$

The punch unit is structured in the following manner: the center of curvature of the punch 55, stripper 54 and its slide surface are the same to form a concentric circle, the center of which is the oscillating central shaft 51A of the bracket 51. The punch 55 is adjustably provided to the lever 52 with a screw. The stripper 54 holds the film 1 so that the film 1 is not moved when the punch 55 perforates the film 1. The stripper 54 is pushed by the spring 53 which is provided between a cover 58 screwed to the lever 52 and the lever 52, so that the stripper 54 is always pushed toward the film surface.

As shown in FIG. 3, chips are dropped into the inside of the drum 11 through a hole 13 which is provided corresponding to the opening 12A of the die 12 on the drum 11. Then, the chips are sucked out of the drum by the suction 106.

The main body 100 is not rotated with regard to the drum 11. The main body 100 may be directly installed on a floor, or on a base having casters so that the main body 100 can be moved.

Figure 4:
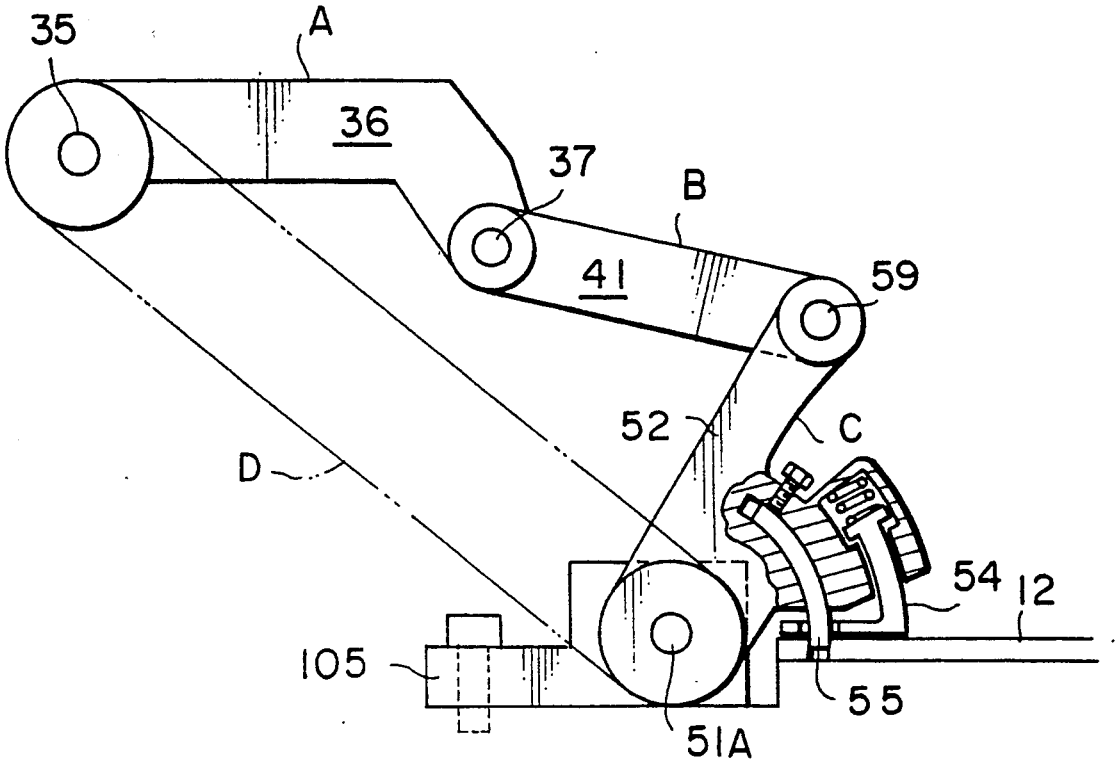
FIG. 4 is a schematic illustration of a 4-rod-link.
Figure 5:
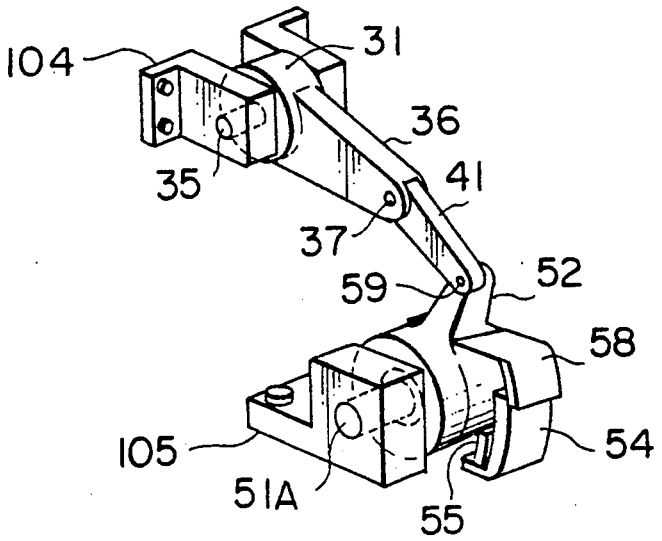
FIG. 5 is a schematic illustration of a 4-rod-link relating to the present invention.
Figure 6:
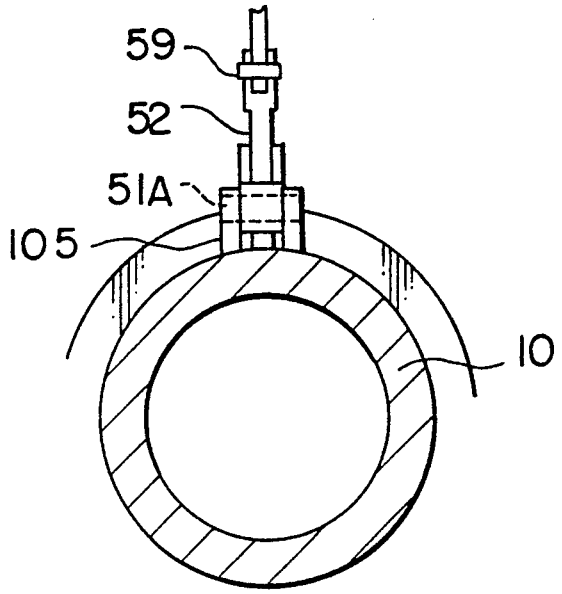
FIG. 6 is a sectional view of the apparatus of the present invention.
Figure 7:
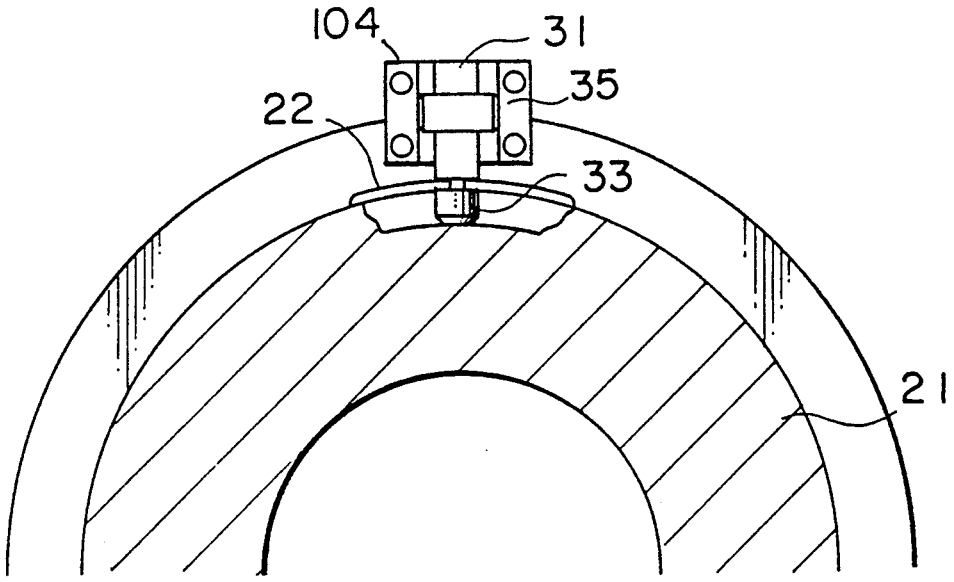
FIG. 7 is a view taken on line VII—VII in FIG. 3.

A link mechanism is a well known technical term in mechanics, which is defined as a mechanism composed of rigid rods rotatably connected with each other, and each rod is referred to as a link. A mechanism composed of 4 rods is referred to as a 4-rod-link. FIG. 4 is a schematic illustration to explain the 4-rod-link. In FIG. 4, when link A is moved under the condition that link D is fixed, links B and C are limitedly moved. Even when link D does not exist, a mechanism substantially functions as a 4-rod-link in the case where 2 points corresponding to both ends of link D are fixed and the distance between the 2 points is constant. In the present invention, the aforesaid mechanism is included, and referred to as a 4-rod-link.

Next, an outline of the operation of the rotary perforator will be explained as follows.

When the main shaft 103 is rotated, the drum 1 is rotated integrally with the main shaft 103. Concurrently when the main shaft 103 is rotated, the film 1 is also rotated which is closely adhered onto the die 12 provided on the outer circumferential surface of the drum 11. When the film 1 passes through the guide roller 107 and is wound around the drum, the stripper 54 and the punch 55, which are provided along the circumference of the drum 11, are located separately from the outer circumferential surface of the drum 11. As the film 1 is contacted with the drum 11, the stripper 54 and the punch 55 conduct perforation on the film 1. As the film 1 is separated from the drum 11 on the guide roller 101 side, the stripper 54 and the punch 55 are separated from the outer circumferential surface of the drum 11.

Figures 8A, 8B, 8C, 8D:
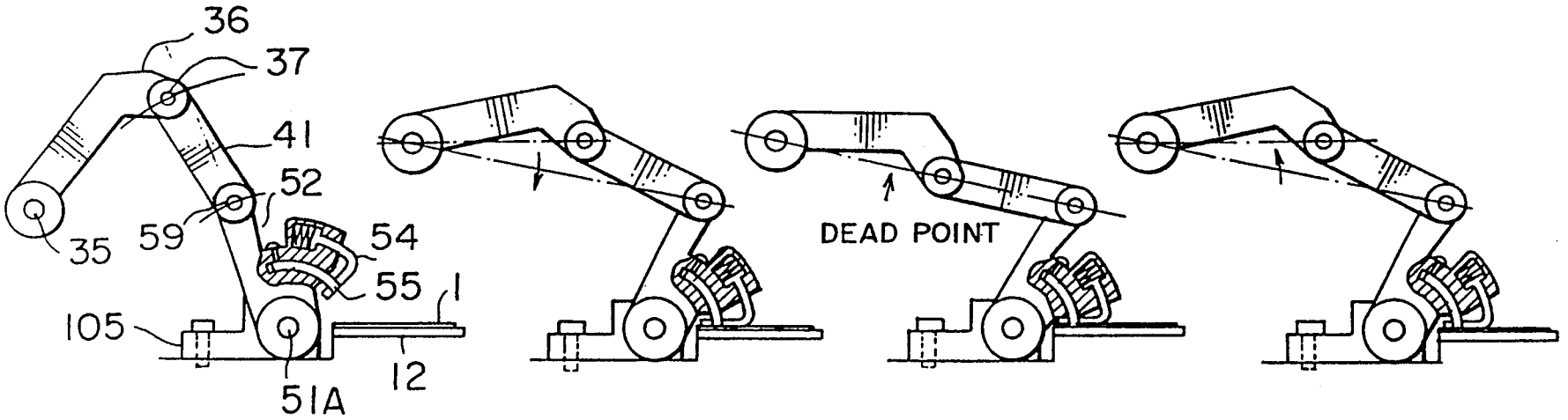
FIGS. 8*a*–8*d* are views showing an example of the operation of the 4-rod-link of the present invention.

FIG. 8 shows a time sequence analysis of the movement of a 4-rod-link . In FIG. 3, the movement of a 4-rod-link is restricted by the roller gear cam 21, and when the roller gear 31 is oscillated around the support shaft 35 due to the orbit of the tapered rib 22, the punch is brought into contact with or separated from the film surface. The roller gear 31 is rotated in an arrowed direction shown in FIG. 8(*b*), and the state shown in FIG. 8(*a*) is changed to the state shown in FIG. 8(*c*). After the operation has reached the state shown in FIG. 8(*c*), the roller gear 31 is rotated in an arrowed direction shown in FIG. 8(*d*) until the state is returned to FIG. 8(*a*). FIG. 8(*a*) shows the state in which the punch 55 is located in the farthest position from the die 12. FIG. 8(*b*) shows the state in which the lever 36 is rotated around the support shaft 35 and approaches the drum 11 side, and the punch 55 is almost brought into contact with the film surface. The film 1 is wound around the drum 11 when the apparatus is in the state shown in FIG. 8(*a*), or the film 1 is wound around the drum 11 in the period of time from when the apparatus is in the state shown in FIG. 8(*a*) to when the apparatus is in the state shown in FIG. 8(*b*) in which the stripper 54 is brought into contact with the film surface. FIG. 8(*c*) shows the state in which the punch 55 perforates the film 1 which is brought into contact with the die 12. In the state shown in FIG. 8(*c*), the lever 36 and the lever 41 are aligned in a line so that a dead point is formed. FIG. 8(*d*) shows the state in which the lever 36 is rotated around the support shaft 35 so that the lever 36 is separated from the drum 11, and FIG. 8(*d*) also shows the state in which the punch 55 is gradually separated from the die 12 after a perforating operation has been conducted on the film 1. The film 1 is separated from the drum 11 in the period of time from when the stripper 54 is separated from the film surface to when the apparatus becomes the state shown in FIG. 8(*a*), or the film 1 is separated from the drum 11 when the apparatus has reached the state shown in FIG. 8(*a*).

The invention described in the aforesaid item (1) to item (3) is especially related to the construction of the drive source of the punch 55. Perforation is finally conducted on the film 1 when the punch 55 is oscillated around the shaft 51A. Therefore, the drive source of the punch 55 is preferably moved in the same manner as the punch 55, and due to the foregoing, the operation can be effectively carried out and a load given to each member can reduced. From the aforementioned viewpoint, the roller gear 31 is oscillated around the support shaft 35, and the movement of the roller gear 31 is similar to that of the punch 55 which perforates the film 1, so that the movement of the roller gear 31 attains the aforementioned purpose.

The positional relation between the roller gear cam 21 and the drum 11 is appropriately determined while consideration is given to various factors such as the dimensions of the drum 11 and the material of the web to be perforated. Accordingly, the roller gear cam 21 is not necessarily provided between the drum 11 and the member 108 as shown in FIG. 3. Further, the roller gear cam 21 is not necessarily fixed to the main body 100, and it is sufficient that the roller gear cam 21 is fixed so that it can not be rotated.

The mechanism composed of a roller gear cam and roller gear has been conventionally used for a dividing mechanism which conducts positioning at regular intervals. In the mechanism of a roller gear cam and roller gear, operations are carried out in the following manner: at least 2 rollers provided to the roller gear are moved on a tapered rib provided on the roller gear cam in such a manner that the 2 rollers pinch the tapered rib. In this manner, the roller gear is oscillated around a predetermined shaft in accordance with the configuration of the tapered rib.

In the apparatus shown in FIG. 3, the roller gear cam and roller gear are used to oscillate the lever 36. However, the essential point of the invention described in items (1) to (3) is to provide a means by which the motion of the lever 36 is made to be the same as that of the punch 55. Accordingly, the present invention is not limited to the specific embodiment, and any means to attain the aforementioned object can be adopted. For example, each shaft 35 may be controlled by a motor or hydraulic pump installed close to the shaft. When means similar to the roller gear cam and roller gear are utilized, the following mechanism may be used: the mechanism is concentrically disposed close to the drum; the mechanism is not rotated with regard to the drum; and the outer circumferential surface of the mechanism is provided with an engaging portion by which the lever 36 is oscillated. The aforesaid engaging portion may be a cam groove and a cam. In this case, the lever 36 can be oscillated when the locus of the cam groove, and the contacting surface between the cam and cam groove are appropriately determined. This mechanism is structured in such a manner that: the roller gear is provided one roller; and tapered ribs on the roller gear cam pinch this roller.

The apparatus has been designed so that a non-uniform load is not given onto the surface of the tapered rib 22 at which the tapered rib 22 comes into contact with the rollers 22 and 32. For example, in the case of the upper roller gear 31 shown in FIG. 3, the surface on which the roller 32 and the tapered rib 22 are brought into contact, is inclined with regard to the main shaft 103. However, the surface on which the roller 33 and the tapered rib 22 are brought into contact, is approximately perpendicular to the main shaft 103. On the contrary, in the lower roller gear 31 shown in FIG. 3, the relation between the roller 32 and the tapered rib 22, and that between the roller 33 and the tapered rib 22 are reverse to the aforementioned case. In the apparatus shown in FIG. 3, the configuration of the tapered rib 22 surface was determined so that the rollers 32 and 33 can be uniformly contacted with the tapered rib 22. Of course, the configurations of the rollers 32 and 33 may be determined so that the rollers 32 and 33 can be uniformly contacted with the tapered rib 22. The rollers 32 and 33 may be made of a metal for bearing use. The tapered rib 22 is preferably made of iron or iron alloy.

It is preferable that lubricating oil is applied to the contact point between the rollers 32, 33 and the tapered rib 22. In this case, it is necessary to take care so as to prevent staining of films caused by leakage of lubricating oil. In the case where grease is utilized as a lubricating agent, it is superior to oil in terms of sealing. The cover 102 shown in FIG. 1, is preferably used for a sealing member to prevent the leakage of a lubricating agent.

Figure 12:
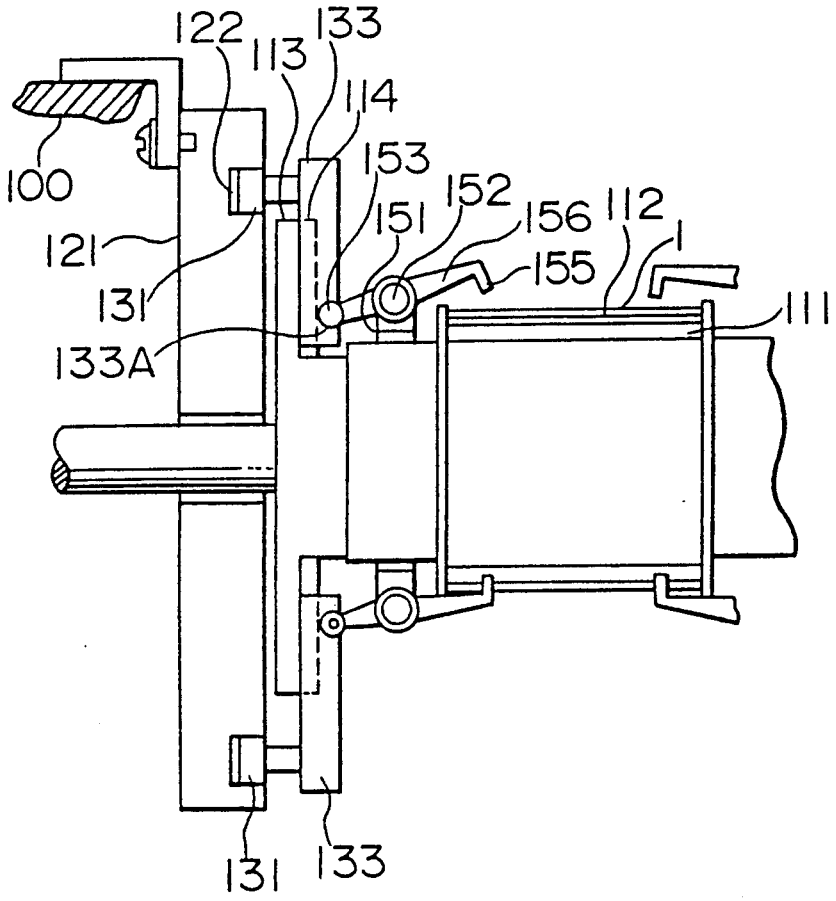
FIG. 12 PRIOR ART
FIGS. 12 and 13 are views showing a conventional machine.
Figure 13:
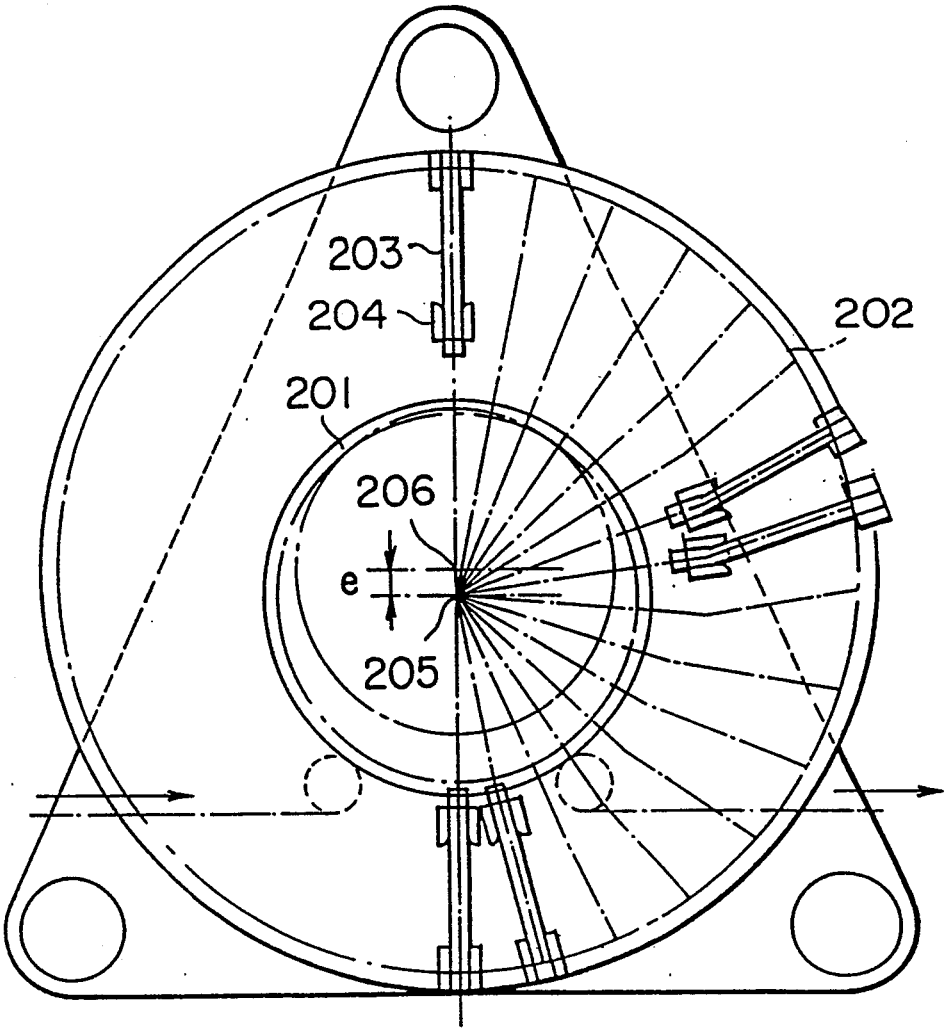
FIG. 13 PRIOR ART
Figure 14:
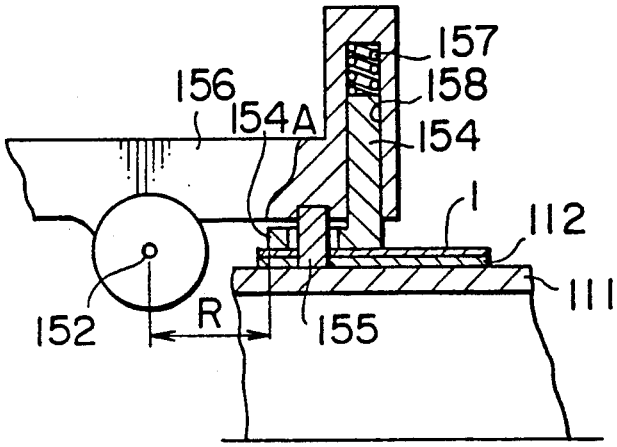
FIG.14 PRIOR ART
FIGS. 14 and 15 are views showing a punch and stripper of a conventional apparatus.
Figure 15:
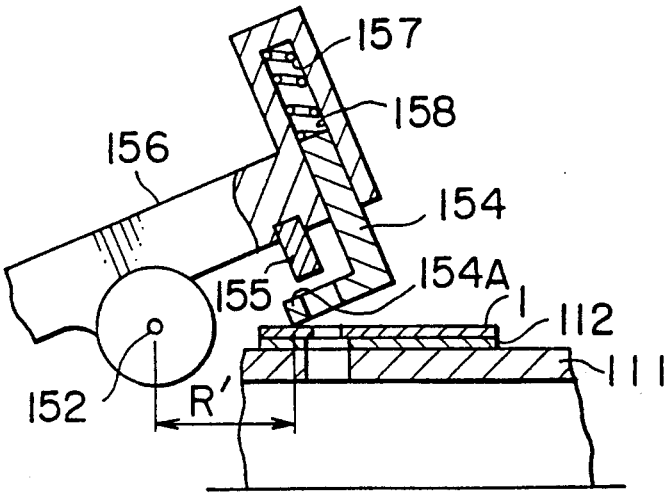
FIG.15 PRIOR ART

In the structure shown in FIG. 3, the lever 36 is connected with other levers 41 and 52, so that a 4-rod-link is formed. As a result, the movement of the roller gear 31 and that of the punch 55 are linked. Incidentally, the means to transmit the movement of the roller gear 31 to the punch 55, is not limited to the embodiment shown in FIG. 3 as far as the aforementioned characteristics of the roller gear 31 is maintained. The punch 55 may be mounted on the tip of the lever 36 so that the film 1 can be directly perforated by the punch 55. The mechanism of the punch 55 is not limited to the aforesaid specific mechanism shown in FIG. 3. For example, the conventional mechanism shown in FIG. 12 may be connected with the tip of the lever 36 of the roller gear 31, wherein the punch is oscillated around the shaft 152 rotated integrally with the drum 111 in the conventional mechanism. The rotary perforator provided with the roller gear cam 21 can be operated at high speed, for example, at a speed of 6000 rpm which is much higher than the speed of 200 rpm of the conventional mechanism. In the apparatus shown in FIG. 8, the punch 55 is contacted with the film surface over a long period of time so that the perforating operation can be carried out gradually. However, when the orbit of the tapered rib 22 is appropriately designed, a perforating operation can be carried out by the punch 55 in a moment, and the punch 55 is quickly separated from the film surface.

The invention described in the item (4) to the item (6) is related to the means by which the punch drive source is linked with the punch. The essential point of the fourth to fifth invention is in that a 4-rod-link is utilized to link the punch 55 with the drive source.

In order for the 4-rod-link to perform its function effectively, it is preferable that the rotating angle of the support shaft 35 is not more than 90° and the rotating angle of the support shaft 51A on the idle side is also not more than 90°.

In the 4-rod-mechanism, it is necessary for the rotation of the drum 11 to effectively affect the motion of the punch 55, which depends on the ratio of the angular velocity of the support shaft 35 of the lever 36 to that of the support shaft 51A of the lever 52, rather than the ratio of the length of each lever. Consequently, the adjustment of the force applied to the punch 55 does not depend on the lever length but depends on the angular velocity around each support shaft. Accordingly, the force can be optionally adjusted when the location of joints of the 4-rod-link is determined. Especially, in the case shown in FIG. 8(*c*) in which the lever 36 and lever 41 are aligned in a line and the joint 37 is disposed close to a dead point (in the dead point, the lever 36 on the drive side can not drive the lever 41 on the idle side), force is gradually given to the film 1 so that the film 1 is perforated. Accordingly, even when the rotating speed of the drum 11 is increased, the rollers 32 and 33 of the roller gear 31, which are the drive source of the 4-rod-link, are not given the force of excessive strength. Therefore, perforating operations can be smoothly carried out at high speed, and perforations of high quality can be provided. The apparatus is not given the force of excessive strength, so that the frequency of maintenance work is remarkably reduced. For example, in the case of a conventional apparatus, it is necessary to conduct 200 times of maintenance work while one million meters of films are perforated. On the other hand, in the apparatus of the present invention, the number of maintenance work can be approximately reduced to zero. In the apparatus shown in FIG. 8, the punch 55 is contacted with the film surface over a long period of time so that the perforating operation can be carried out gradually. However, it is possible that a perforating operation is conducted in a moment and the punch is quickly separated from the film surface when the arrangement of each lever composing the 4-rod-link is adjusted.

Figure 9A:
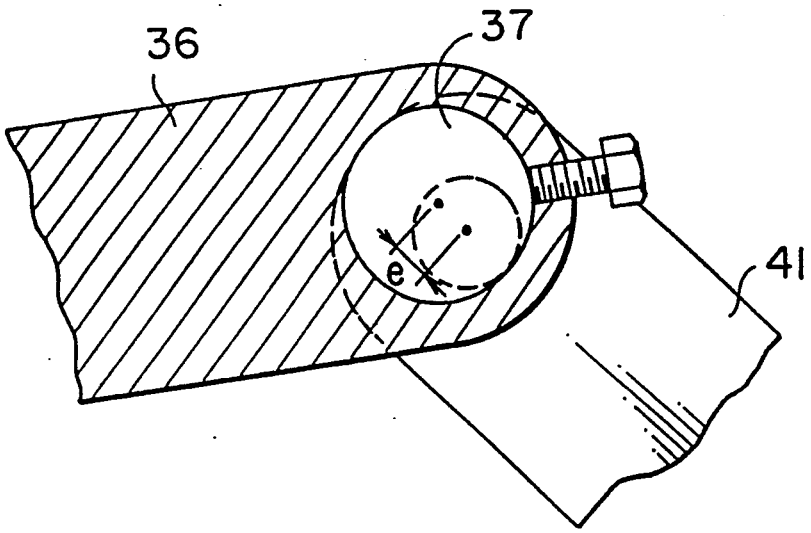
FIGS. 9*a* and 9*b* are views showing an example of the joint of the 4-rod-link of the present invention.
Figure 9B:
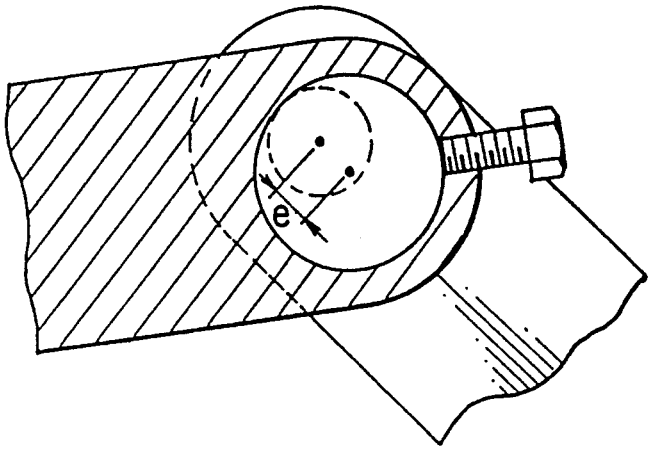

Any joints used for a link can be applied to the joints 37 and 59 of the 4-rod-link. The type of the joint is appropriately selected according to the effect of the present invention. For example, a means used for an independent wheel joint of an automobile can be applied to the apparatus of the present invention. All levers 36, 41 and 52 composing the 4-rod-link of relating to the invention are on a surface which is approximately in parallel with the surface including the main shaft 103, and the levers are operated integrally with each other without being twisted. In order to arrange these levers with accuracy, and make it easy to assemble the 4-rod-link, for example, a ball joint in which a lever and joint are integrated with each other, may be applied to the lever 41 and joint 59. Joints are eccentrically connected as shown in FIG. 9. When the joints are eccentrically connected, the engagement between the punch and die 12 can be easily adjusted, and even when the film thickness is changed, adjustment can be flexibly carried out.

In FIG. 3, an embodiment is shown in which the roller gear cam 21, roller gear 31 and 4-rod-link are combined. Instead of the roller gear cam 21 and roller gear 31, a crank mechanism and eccentric cam may be combined with the 4-rod-link. The means to drive the 4-rod-link can be optionally selected as far as the aforesaid advantage of the 4-rod-link can be maintained, that is, the advantage is that the force given to the punch 55 can be optionally adjusted irrespective of the lever length. The 4-rod-link of the present invention can be used not only for a rotary perforator which perforates a film wound around the drum 1, but also other machines. Further, the 4-rod-link of the present invention can be used for a machine in which perforation is conducted without using a rotating drum 1.

In the embodiment shown in FIG. 3, the roller gear cam 21, roller gear 31 and 4-rod-link are combined. In the apparatus shown in FIG. 3, the roller gear cam 21 and roller gear 31 are adopted in order to effectively transmit the rotation of the drum 11 to the punch 55, and further the 4-rod-link is combined is combined in order to effectively transmit the rotation of the roller gear to the punch 55. Therefore, transmission of energy is effective so that energy loss is reduced to the minimum. As a result, the productivity of the machine of the invention is higher than that of a conventional machine.

Weight of the members used for the machine of the invention is preferably light from the viewpoint of cost and handling. Especially, weight of the punch unit members is preferably light as far as the inertia force necessary for carrying out a perforating operation can be maintained.

It is not necessary to use the punch 55 and die 12 having a special configuration in the present invention. An appropriate punch and die of the prior art can be used. From the viewpoint of carrying out perforation with high accuracy, an arcuate punch and die, the radius of curvature of which is the same as that of an arc formed around the oscillation shaft, are preferably adopted as disclosed in Japanese Utility Model No. 39036/1988.

The punch 55 is preferably adjustably fixed with a screw as shown in FIG. 4 in such a manner that the rear portion of the punch 55 is engaged with screw, because the length of the punch 55 can be easily adjusted when the punch is ground in the case of abrasion.

Figure 10:
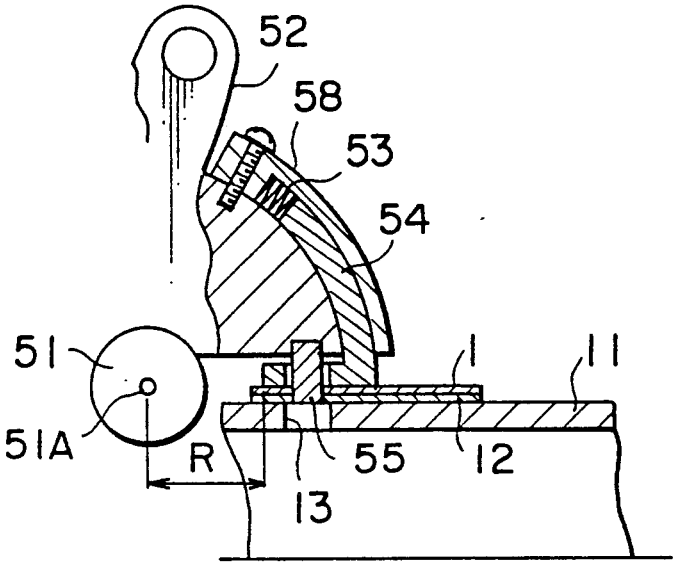
FIGS. 10 and 11 are views showing an example of a punch and stripper of the present invention.
Figure 11:
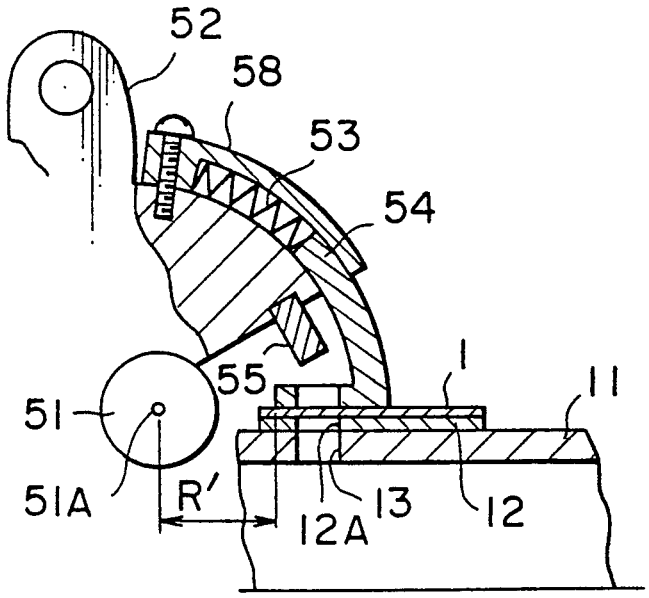

As shown in FIGS. 10 and 11, the configuration of the supporting member in the stripper 54 (the configuration of sliding surface between the lever and the stripper 54), for supporting a member which fixes a film, is preferably formed arcuate, the radius of curvature of which is the same as an arc formed around the support shaft 51A. The stripper structured in the aforementioned manner is advantageous in that: in a period of time from when the punch 55 is inserted into and engaged with the die 12 and all the surface of the stripper is brought into contact with the film surface as shown in FIG. 10, to when the lever 52 is rotated around the support shaft 51A and the stripper 54 is separated from the die 12 as shown in FIG. 11, all the surface of the stripper 54 is not relatively moved with regard to the die 12 or the film 1. When the support shaft 51A is disposed on the same plane as the surface of the film 1, the edge portion of the stripper 54 does not come into contact with the film surface when the stripper 54 is separated from the film surface. Therefore, scratches are not caused at all by the tip of the stripper 54. In the machine shown in FIGS. 10 and 11, the configuration of the punch 55 is not formed arcuate, however, the configuration of the punch 55 is preferably formed arcuate, the center of curvature of which is the same as the concentric circle formed around the support shaft 51A, in the same manner as the stripper 54. In the apparatus shown in FIGS. 10 and 11, the stripper 54 is provided with a cover 58 formed outside the lever 52. However, the present invention is not limited to the specific embodiment. The stripper 54 and punch 55 may be provided integrally with the lever 52. The stripper 54 and punch 55, the configurations of which are shown in FIGS. 10 and 11, are preferably incorporated into each of the aforesaid invention so as to obtain further effect. Especially, it is preferable that the stripper 54 and punch 55, the configurations of which are shown in FIGS. 10 and 11, are applied to the machine shown in FIG. 3 in which the roller gear cam 21, roller gear 31 and 4-rod-link are combined.

According to the present invention explained above, it has become possible to provide a perforator and perforation method, the productivity of which is remarkably higher than that of a machine of the prior art. That is, it has become possible to provide a perforator perforation method in which the frequency of maintenance work is reduced and perforating operation can be carried out at high speed. Further, according to the present invention, perforated webs of high quality can be provided.

What is claimed is:

1. A perforating apparatus for perforating a web, comprising:

a rotatable drum for supporting said web;

a plurality of arms, each of said arms having a punch;

a plurality of means for swinging each of said arms, wherein each of said swinging means has a roller gear including two rollers and a first shaft, each first shaft being tangent to an imaginary circle located in a plane extending perpendicular to an axis of the drum; and a fixed member, which does not rotate with said drum, having a roller gear cam that engages said swinging means, wherein said roller gear cam has a rib and each of said swinging means moves along said rib by pinching said rib with said two rollers so that said roller gear cam causes each of said swinging means to swing around said first shaft and said punch perforates said web upon rotation of said drum.

2. The apparatus of claim 1, further comprising:

a stripper, wherein both said punch and said stripper swing around a second shaft provided on a circumference of said drum, and said stripper moves in a circular arc around said second shaft.

3. The apparatus of claim 2, wherein said punch moves in a circular arc around said second shaft.

4. The apparatus of claim 1, wherein said punch swings around a second shaft provided on a circumference of said drum.

5. The apparatus of claim 4, wherein each of said arms is a first arm that swings around said second shaft, and each of said swinging means further comprises:

a second arm which swings around said first shaft; and a third arm which movably connects said first arm with said second arm.

6. The apparatus of claim 5, wherein said second arm and said third arm are adjacent to a dead point when said punch perforates said web.

7. The apparatus of claim 5, further comprising a stripper, wherein both said punch and said stripper move with said first arm and said stripper moves in a circular arc around said second shaft.

8. The apparatus of claim 7, wherein said punch moves in a circular arc around said second shaft.

9. The apparatus of claim 1, further comprising a stripper.

10. A method of perforating a web, comprising the steps of:

holding said web on an apparatus comprising a rotatable drum for supporting said web; a plurality of arms, each of said arms having a punch; a plurality of means for swinging each of said arms, wherein each of said swinging means has a roller gear including two rollers and a first shaft, each first shaft being tangent to an imaginary circle located in a plane extending perpendicular to an axis of the drum; and a fixed member, which does not rotate with said drum, having a roller gear cam that engages said swinging means, wherein said roller gear cam has a rib and each of said swinging means moves along said rib by pinching said rib with said two rollers so that said roller gear cam causes each of said swinging means to swing around said first shaft and said punch perforates said web upon rotation of said drum; and perforating said web.

11. A method for perforating a web, comprising the steps of:

holding said web on an apparatus comprising a rotatable drum for supporting said web; a punch which rotates integrally with said drum; means for swinging said punch which rotates integrally with said drum and comprises a first shaft, around which said punch swings; a first arm which swings around said first shaft upon rotation of said drum and moves with said punch; a second shaft; a second arm which swings around said second shaft; and a third arm which movably connects said first arm with said second arm, wherein said first shaft and said second shaft both rotates integrally with said drum and a distance between said first shaft and said second shaft is constant during rotation of said drum; means for driving said swinging means so that said second arm swings around said second shaft upon rotation of said drum and causes said punch to perforate said web, and a stripper, wherein both said punch and said stripper swing around said first shaft, which is provided on a circumference of said drum, and said stripper moves in a circular arc around said first shaft; and perforating said web.

12. A perforating apparatus for perforating a web, comprising:

a rotatable drum for supporting said web;

a punch which rotates integrally with said drum;

means for swinging said punch, which means rotates integrally with said drum and comprises a first shaft, around which said punch swings;

a first arm which swings around said first shaft upon rotation of said drum and moves with said punch;

a second shaft;

a second arm which swings around said second shaft; and a third arm which movably connects said first arm with said second arm, wherein said first shaft and said second shaft both rotate integrally with said drum, and a distance between said first shaft and said second shaft is constant during rotation of said drum; and means for driving said swinging means, so that said second arm swings around said second shaft upon rotation of said drum and causes said punch to perforate said web, said driving means comprising a fixed member, which does not rotate with said drum, having means for engaging said swinging means, wherein said fixed member is a roller gear cam, said engaging means is a tapered rib, and said swinging means comprises a roller gear which has two rollers and moves along said tapered rib by pinching said tapered rib with said two rollers.

13. The apparatus of claim 12, wherein said second arm and said third arm are adjacent to a dead point when said punch perforates said web.

14. The apparatus of claim 12, wherein said punch moves in a circular arc around said first shaft.

15. A perforating apparatus for perforating a web, comprising:

a rotatable drum for supporting said web;

a punch which rotates integrally with said drum;

means for swinging said punch, which means rotates integrally with said drum and comprises a first shaft, around which said punch swings;

a first arm which swings around said first shaft upon rotation of said drum and moves with said punch;

a second shaft;

a second arm which swings around said second shaft; and a third arm which movably connects said first arm with said second arm, wherein said first shaft and said second shaft both rotate integrally with said drum, and a distance between said first shaft and said second shaft is constant during rotation of said drum;

means for driving said swinging means, so that said second arm swings around said second shaft upon rotation of said drum and causes said punch to perforate said web; and a stripper, wherein both said punch and said stripper swing around said first shaft, which is provided on a circumference of said drum, and said stripper moves in a circular arc around said first shaft.

16. The apparatus of claim 15, wherein said driving means comprises a crank mechanism and an eccentric cam.

17. The apparatus of claim 15, wherein said second arm and said third arm are adjacent to a dead point when said punch perforates said web.

18. The apparatus of claim 15, wherein said punch moves in a circular arc around said first shaft.

19. The apparatus of claim 15, wherein said driving means comprises a fixed member which does not rotate with said drum and said fixed member has means for engaging said swinging means.

20. The apparatus of claim 9, wherein said fixed member is a roller gear cam, said engaging means is a tapered rib, and said swinging means comprises a roller gear which has two rollers and moves along said tapered rib by pinching said tapered rib with said two rollers.

21. The apparatus of claim 20, wherein said second arm and said third arm are adjacent to a dead point when said punch perforates said web.

22. The apparatus of claim 20, wherein said punch moves in a circular arc around said first shaft.

23. The apparatus of claim 23, wherein said punch moves in a circular arc around said first shaft.

24. The apparatus of claim 19, wherein said swinging means further comprises a roller that engages said engaging means.

25. The apparatus of claim 19, wherein said second arm and said third arm are adjacent to a dead point when said punch perforates said web.

* * * * *

UNITED STATES PATENT AND TRADEMARK OFFICE

CERTIFICATE OF CORRECTION

PATENT NO. : 5,317,942
DATED : June 07, 1994
INVENTOR(S) : Syuiti Nakajima

It is certified that error appears in the above-indentified patent and that said Letters Patent is hereby corrected as shown below:

Claim 11, column 14, line 5, change "rotates" to --rotate--.

Claim 20, column 16, line 3, change "9" to --19--.

Claim 23, column 16, line 13, change "claim 23" to --claim 19--.

Signed and Sealed this

Twenty-seventh Day of December, 1994

*Attest:*

Bruce Lehman

BRUCE LEHMAN

*Attesting Officer*

*Commissioner of Patents and Trademarks*